US009796513B2

(12) United States Patent
Ziegenfelder et al.

(10) Patent No.: US 9,796,513 B2
(45) Date of Patent: Oct. 24, 2017

(54) OVERCAP WITH CUTTING RING FOR RIGID PAPER CANS

(71) Applicant: SONOCO DEVELOPMENT, INC, Hartsville, SC (US)

(72) Inventors: Kurt Allen Ziegenfelder, Florence, SC (US); Lawrence R. Carpenter, Darlington, SC (US)

(73) Assignee: Sunoco Development, Inc., Hartsville, SC (US)

( * ) Notice: Subject to any disclaimer, the term of this patent is extended or adjusted under 35 U.S.C. 154(b) by 461 days.

(21) Appl. No.: 14/512,603

(22) Filed: Oct. 13, 2014

(65) Prior Publication Data

US 2016/0101913 A1 Apr. 14, 2016

(51) Int. Cl.

| | |
|---|---|
| ***B65D 51/24*** | (2006.01) |
| ***B65D 17/00*** | (2006.01) |
| *B65D 51/00* | (2006.01) |
| *B65D 3/26* | (2006.01) |

(52) U.S. Cl.

CPC ..... *B65D 51/243* (2013.01); *B65D 3/268* (2013.01); *B65D 17/18* (2013.01); *B65D 3/26* (2013.01); *B65D 51/00* (2013.01); *B65D 51/24* (2013.01)

(58) Field of Classification Search

CPC .... B65D 50/041; B65D 50/045; B65D 51/22; B65D 51/226; B65D 51/228; B65D 51/243; B65D 49/00; B65D 49/12; B65D 43/14; B65D 17/00; B65D 17/02; B65D 17/06; B65D 17/16; B65D 17/18; B65D 15/04; B65D 15/06; B65D 15/08; B65D 3/26; B65D 3/268; B65D 75/40; B65D 51/00; B65D 51/24; B67B 7/30; B67B 2007/385

USPC ..... 53/381.2, 381.4, 492; 83/186, 189; 220/260, 265, 267, 288, 276, 278, 212, 220/251.6, 269, 277; 81/3.29, 186, 189, 81/3.07, 3.15, 3.4, 3.41; 229/4.5, 93; 215/257

See application file for complete search history.

(56) References Cited

U.S. PATENT DOCUMENTS

| | | | | | |
|---|---|---|---|---|---|
| 3,195,799 | A * | 7/1965 | Denenberg | B65D 3/26 | 229/201 |
| 3,278,578 | A | 10/1966 | Frankel | | |
| 3,378,163 | A * | 4/1968 | Griffith | B65D 15/06 | 220/260 |
| 3,797,688 | A * | 3/1974 | Porcelli | B65D 50/041 | 215/220 |
| 4,241,864 | A * | 12/1980 | Kessler | B65D 15/08 | 215/233 |
| 4,346,832 | A * | 8/1982 | Werner | B29C 53/42 | 206/508 |
| 4,428,741 | A * | 1/1984 | Westphal | B65D 15/06 | 493/103 |
| 4,567,995 | A * | 2/1986 | Kreiseder | B65D 47/265 | 220/253 |
| 4,706,835 | A * | 11/1987 | Kreiseder | B65D 51/228 | 220/214 |

(Continued)

*Primary Examiner* — Nathaniel Chukwurah
*Assistant Examiner* — Eduardo R Ferrero
(74) *Attorney, Agent, or Firm* — Miller, Matthias & Hull LLP

(57) ABSTRACT

A novel closure for a container is provided. The closure comprises an overcap and a built in blade ring for making a circumferential cut in the container body so the top portion of the body can be removed to expose the container contents.

8 Claims, 4 Drawing Sheets

(56) References Cited

U.S. PATENT DOCUMENTS 4,789,057 A * 12/1988 Fisher ..... B65D 50/045 206/1.5
4,901,435 A * 2/1990 Tahara ..... B65D 17/18 220/267
5,012,970 A * 5/1991 Kucherer ..... B05B 11/0037 220/289
5,052,568 A * 10/1991 Simon ..... B65D 41/18 215/250
5,082,136 A 1/1992 Schumann
5,161,706 A * 11/1992 Weinstein ..... B65D 50/041 215/204
5,217,130 A * 6/1993 Weinstein ..... B65D 50/041 215/206
5,219,084 A * 6/1993 King ..... B65D 1/02 215/220
5,381,917 A * 1/1995 Santagiuliana ..... B65D 50/041 220/219
5,694,822 A * 12/1997 Maidment ..... B23D 31/001 83/114
5,878,497 A * 3/1999 Seemann, III ..... B67B 7/0441 30/1.5
5,887,744 A * 3/1999 Mejias ..... B65D 50/067 220/284
5,947,318 A * 9/1999 Palm ..... B65D 5/746 220/278
6,568,549 B1 * 5/2003 Miller ..... B67B 7/06 215/228
7,100,473 B2 * 9/2006 Hefti ..... B67B 7/18 81/3.36
7,703,626 B2 * 4/2010 Witt ..... B29C 65/10 215/252
7,784,633 B2 * 8/2010 Luburic ..... B65D 43/0212 215/304
7,886,922 B2 2/2011 Seelhofer
7,988,003 B1 * 8/2011 Clodfelter ..... B65D 50/041 215/220
8,118,185 B2 * 2/2012 Smith ..... B65D 43/0256 215/228
8,157,115 B2 * 4/2012 Rho ..... B65D 50/041 215/220
8,820,554 B2 * 9/2014 Rho ..... B65D 51/224 215/253
9,334,082 B2 * 5/2016 D'Anglade ..... B65D 15/04
2007/0090110 A1 * 4/2007 Skelton ..... B65D 41/0478 220/254.9
2009/0250462 A1 * 10/2009 Haimi ..... B65D 50/041 220/260
2011/0094990 A1 * 4/2011 Sprishen ..... B65D 50/041 215/217
2013/0015157 A1 * 1/2013 Rho ..... B65D 50/041 215/217
2013/0240527 A1 * 9/2013 Philippe ..... B44D 3/12 220/270

* cited by examiner

OVERCAP WITH CUTTING RING FOR RIGID PAPER CANS

BACKGROUND OF THE INVENTION

Field of the Invention

This disclosure patent relates to an overcap for a rigid paper can. More particularly, this disclosure relates to an overcap for a rigid paper can wherein the overcap has a cutting ring for opening the rigid paper can.

Description of the Related Art

Rigid cylindrical composite containers used to hold goods such as snacks and other food items are an important product in the packaging industry. These containers usually are manufactured with open ends, one of which may be closed with a metal or plastic bottom closure. The top end may be sealed with a peel-off membrane and an overcap. The membrane is used to guard against tampering and ensure content safety and freshness. The consumer must remove both the overcap and the membrane before use. The overcap can be replaced if the contents are not consumed all at once.

The present disclosure describes an alternative overcap having a "built-in" cutting ring for opening the rigid paper can, thereby eliminating the need to remove a membrane.

BRIEF SUMMARY OF THE INVENTION

The disclosure relates to a closure for a container. The closure comprises an overcap and a built in blade ring for making a circumferential cut in the container body so the top portion of the body can be removed to expose the container contents.

The overcap may comprise a covering portion and an annular portion comprising an annular rim, an outer skirt extending downward from an outer edge of the rim and an annular inner wall extending downward from an inner edge of the rim to the covering portion.

The blade ring is affixed to an interior surface of the overcap outer skirt. The blade ring comprises at least two teeth segments circumferentially spaced around and extending radially inwardly from a ring-like structure. A teeth segment body is located on an outer surface of the ring-like structure opposite each teeth segment. Each teeth segment body has a raised trailing portion extending radially outward from the rest of the blade ring, a stopping edge circumferentially rearward of the trailing portion, and a forward edge circumferentially opposite the stopping edge. The teeth segments may be slightly spaced from the container body.

The overcap outer skirt may have an interior surface and define circumferentially spaced apart recesses for receiving and retaining each teeth segment body.

The outer skirt may define a plurality of circumferentially spaced apart spaces for receiving the raised trailing portion of each teeth segment body. The outer skirt may comprise one or more inwardly extending cams configured to push against the raised trailing portions when a radially inward force is imposed on the outer skirt. The outer skirt may further comprise one or more inwardly extending lugs, where each lug has a forward facing surface that faces one of the spaces in the outer skirt. Each forward facing surface is configured to push against a corresponding raised trailing portion when the outer skirt is squeezed and rotated.

In another aspect of the disclosure a method of opening a container sealed by the closure described above is provided. The method may comprise the steps of: squeezing the outer skirt until the teeth segments cut into the body; rotating the overcap to make one or more circumferential cuts in the body until the body is cut circumferentially into two pieces; and lifting off the overcap.

In the method described above the outer skirt may be squeezed at two places around the overcap about 180 degrees apart and coinciding with the location of two of the teeth segments and the overcap is rotated degrees.

Alternatively, the blade ring may comprise six teeth segments, the overcap is squeezed at places coinciding with the six teeth segments, and the overcap is rotated 60 degrees.

DETAILED DESCRIPTION OF THE INVENTION

Figure 1:
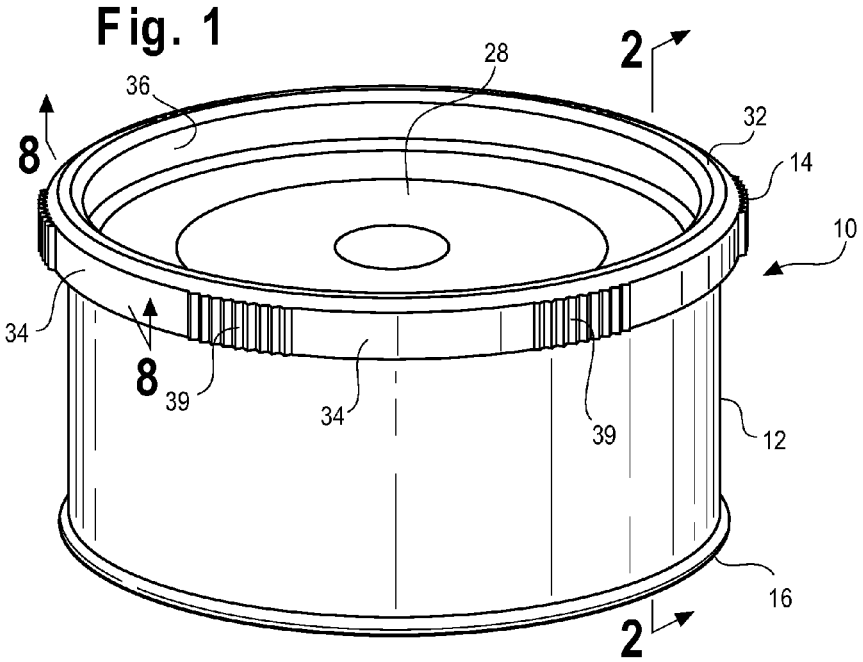
FIG. 1 is a perspective view of a container.

While the invention described herein may be embodied in many forms, there is shown in the drawings and will herein be described in detail one or more embodiments, with the understanding that this disclosure is to be considered an exemplification of the principles of the invention and is not intended to limit the invention to the illustrated embodiments.

The disclosure relates to an overcap having a "built-in" cutting ring for opening the rigid paper can, thereby eliminating the need to remove a membrane.

Rigid composite containers are used to package various products such as snacks and other food items. These containers often comprise a rigid cylindrical or shaped body usually manufactured with open top and bottom ends. One or both ends may be sealed with paper-based ends or ends made of metal, flexible polymer material, or composite materials. While the bottom end is usually affixed to the container, the top end is often designed to be easily removed by the consumer.

FIG. 1 is a perspective view of a sample rigid composite container 10. The container 10 comprises a container body 12 and an overcap 14. The container body 12 has a top opening and a bottom opening. The bottom opening is sealed with a bottom end or closure 16. The top opening is sealed with the overcap 14. The body 12 has an inner (content facing) surface 22 and an outer surface 24.

Figure 2A:
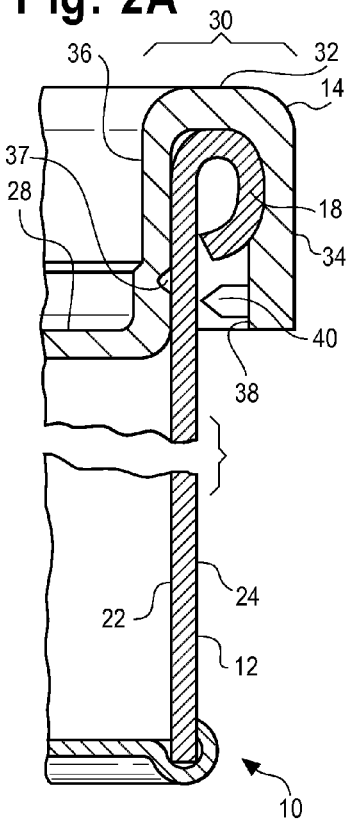
FIG. 2A is a cross-sectional view of the container of FIG. 1 taken along line 2-2 showing the container before opening.

FIG. 2A is a cross-sectional view of the container 10 of FIG. 1 taken along line 2-2. The overcap 14 may comprise a circular covering portion 28 and an annular portion 30 configured to overlay the container's beaded top rim 18. The annular portion 30 may comprise an annular rim 32, an outer skirt 34 extending downward from the rim 32 adjacent the outer surface 24 of the paper can body 12, and an annular inner wall 36 that extends downward from the rim 32 adjacent the inner surface 22 of the paper can body 12 to the covering portion 28. The covering portion 28 may be countersunk with respect to the container top rim 18. Raised or textured gripping sections 39 (FIG. 1) may be circumferentially disposed around the outer skirt 34. A blade ring 40 is affixed to the overcap as explained below. The inner skirt 36 may define a continuous or discontinuous annular recess 37 located approximately radially inward from the blade ring 40. The overcap 14 may be plastic or any suitable material.

Figure 2B:
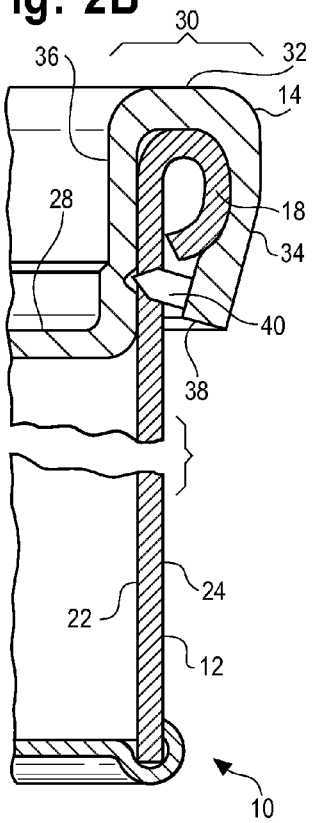
FIG. 2B is a cross-sectional view of the container of FIG. 1 showing the container during opening.

FIG. 2B is a cross-sectional view of the container 10 of FIG. 1 shown being opened. When the overcap 14 is squeezed at the gripping sections 39, teeth segments 42 (FIG. 9) of the blade ring 40 are pushed into the can body 12.

Figure 3:
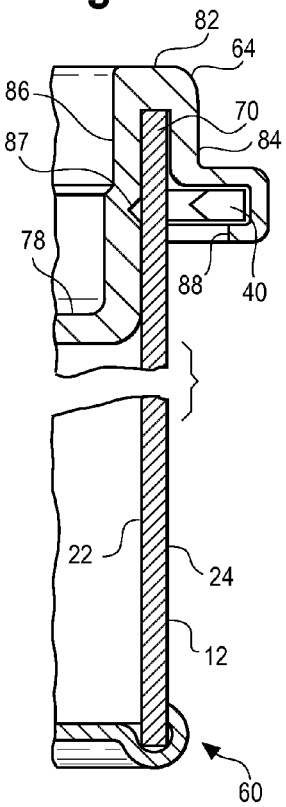
FIG. 3 is a cross-sectional view of an alternative embodiment of a container showing the container before opening.

FIG. 3 is a cross-sectional view of an alternative embodiment of a container 60 showing the container 60 before opening. Like the previous embodiment shown in FIGS. 2A and 2B, the container 60 comprises a container body 12 and an overcap 64. Unlike the previous embodiment the body 64 has a straight top rim 70.

Still referring to FIG. 3, the overcap 64 is configured to accommodate the straight rim 70, and comprises a circular covering portion 78 and an annular portion configured to overlay the container top rim 70. The annular portion may comprise a rim 82, an outer skirt 84 extending downward from the rim 82 adjacent the outer surface 24 of the can body 12, and an annular inner wall 86 that extends downward from the rim 82 adjacent the inner surface 22 of the can body 82 to the covering portion 28. The outer skirt 84 has an interior surface 88 and may define a continuous or discontinuous annular recess 87 located radially inward from the blade ring 40.

Figure 4:
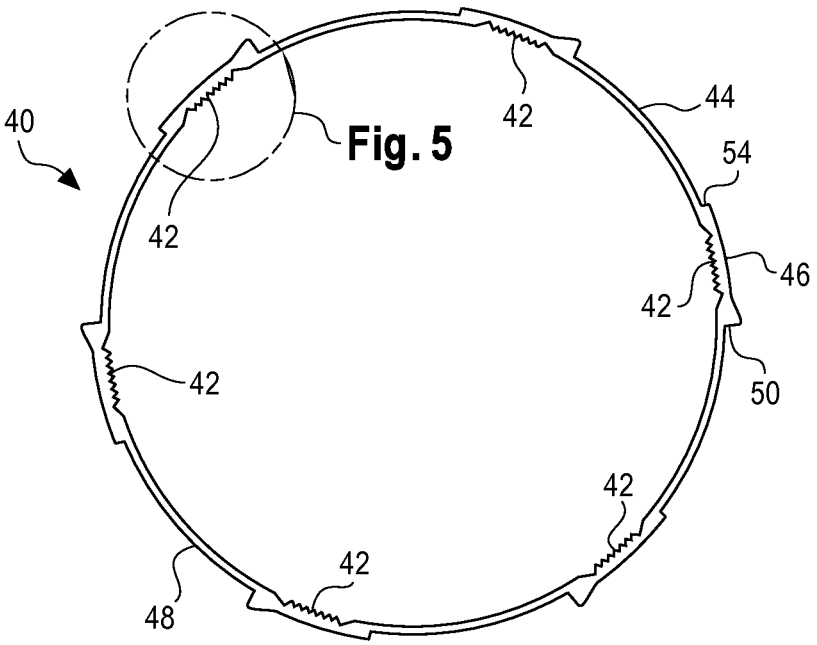
FIG. 4 is a top plan view of one embodiment of a blade ring used as a component of an overcap according to the disclosure.
Figure 5:
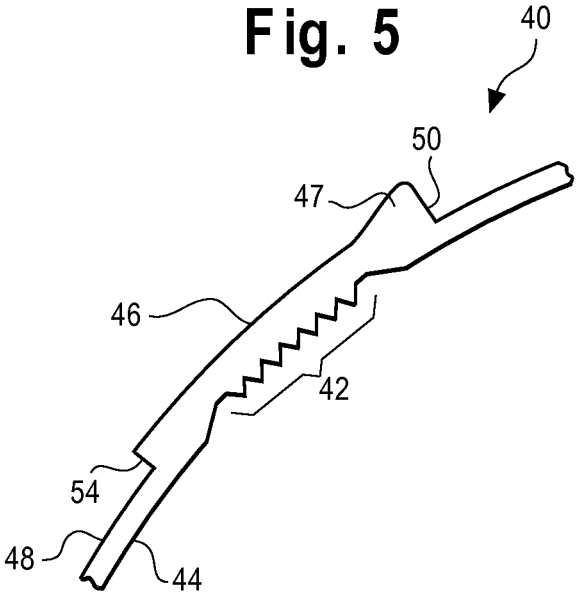
FIG. 5 is an enlarged view of a portion of the blade ring of FIG. 4.

FIG. 4 is a top plan view of a blade ring 40 and FIG. 5 is an enlarged view of a portion of the blade ring 40 of FIG. 4. The blade ring 40 comprises at least two and preferably six teeth segments 42 circumferentially spaced around and extending inwardly from a ring-like structure 44. A thickened area, a.k.a. the teeth segment body 46, is located on the outer surface 48 of the ring-like structure 44 opposite each teeth segment 42. Each teeth segment body 46 has a raised trailing portion 47, a stopping edge 50 rearward of the trailing portion 47, and a forward edge 54 opposite the stopping edge 50. The trailing portion 47 extends radially outward from the rest of the blade ring 40. The blade ring 40 may be metal, plastic or any suitable resilient material.

Figure 6:
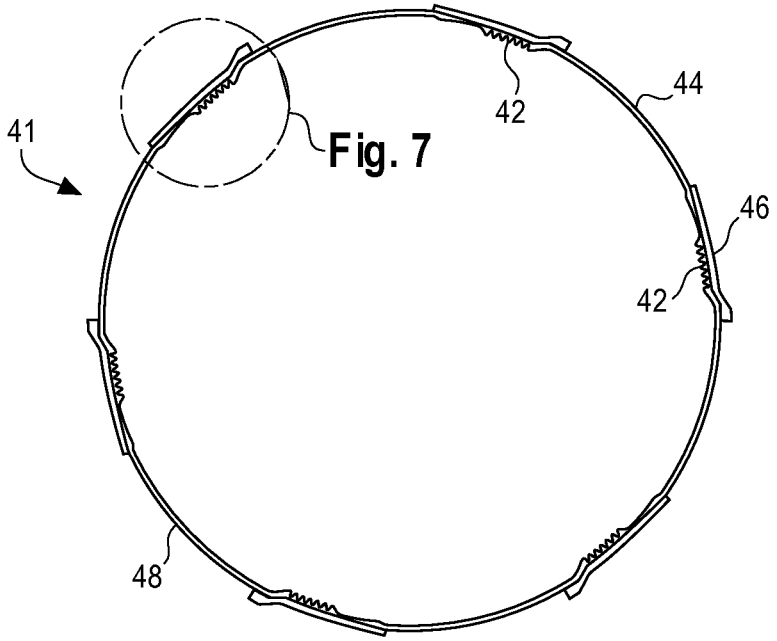
FIG. 6 is a top plan view of an alternative embodiment of a blade ring.
Figure 7:
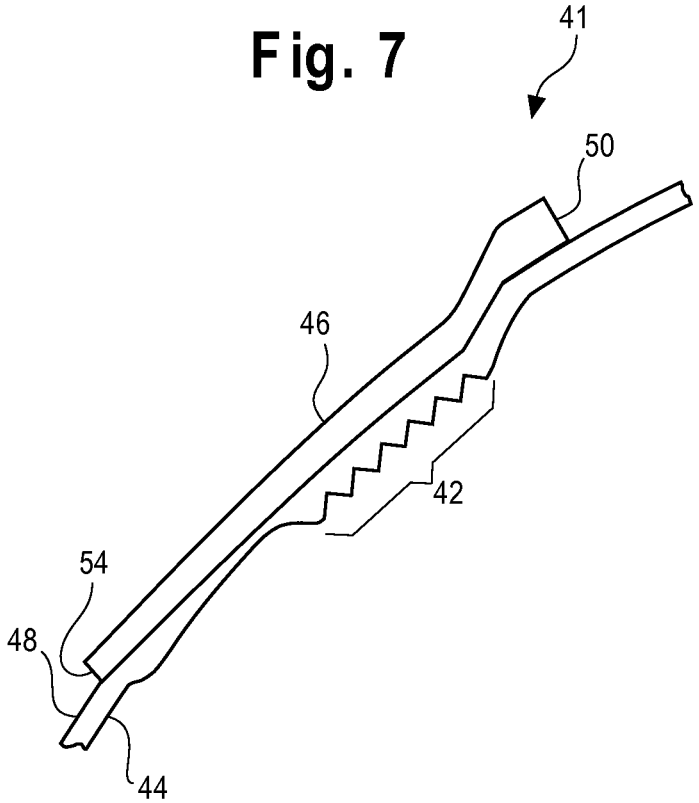
FIG. 7 is an enlarged view of a portion of the blade ring of FIG. 6.

FIG. 6 is a top plan view of an alternative embodiment of a blade ring 41 and FIG. 7 is an enlarged view of a portion of the blade ring of FIG. 6. Like the previous embodiment, the blade ring 41 comprises at least two and preferably six teeth segments 42 circumferentially spaced around and extending inwardly from a ring-like structure 44. A teeth segment body 46 is located on the outer surface 48 of the ring-like structure 44 opposite each teeth segment 42. Each teeth segment body 46 has a stopping edge 50 and a forward edge 54 opposite the stopping edge 50.

The operation of the combination overcap 14 and blade ring 40 will now be described with respect to FIGS. 8 to 10.

Figure 8:
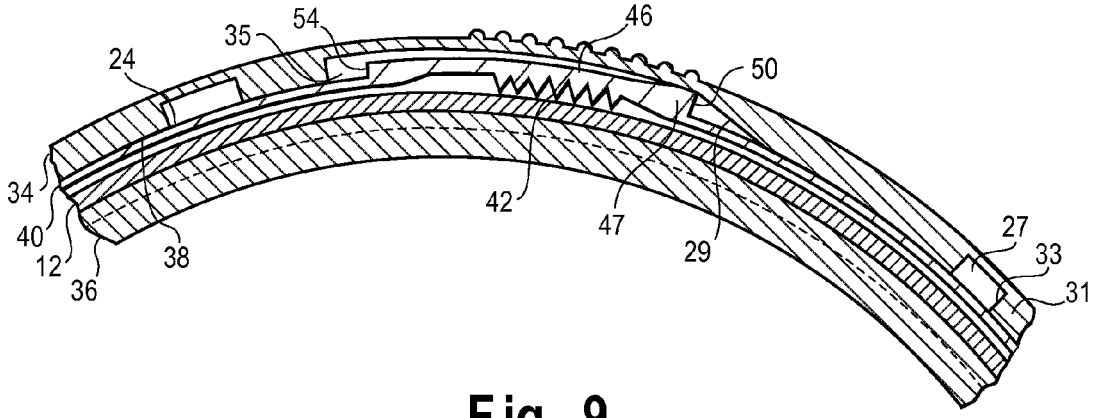
FIG. 8 is an enlarged cross-sectional view of the container of FIG. 1 taken along line 8-8.

FIG. 8 is an enlarged cross-sectional view of the container 10 of FIG. 1 taken along line 8-8. From inside out, FIG. 8 shows cross-sections of the overcap inner skirt 36, the can body 12, a gap or space, the blade ring 40 and the overcap outer skirt 34. A broken line in FIG. 8 indicates the inner boundary of the annular recess 37 defined by the overcap inner wall 36, better shown in FIG. 2A.

The overcap outer skirt 34 has an interior surface 38 and defines circumferentially spaced apart recesses 35 for receiving and retaining each teeth segment body 46.

The blade ring 40 is affixed to or otherwise held by the interior surface 38 of the overcap outer skirt 34 and has teeth segments 42 pointed radially inward. The teeth segments 42 may contact the can body 12 or, as shown in FIGS. 2A and 8, may be slightly spaced from the can body 12.

The outer skirt 34 defines a plurality of circumferentially spaced apart spaces 27 and comprises one or more inwardly extending sloped surfaces or cams 29 and one or more inwardly extending lugs 31, with each lug 31 having a forward facing surface 33 facing one of the spaces 27 in the outer skirt 34.

Figure 9:
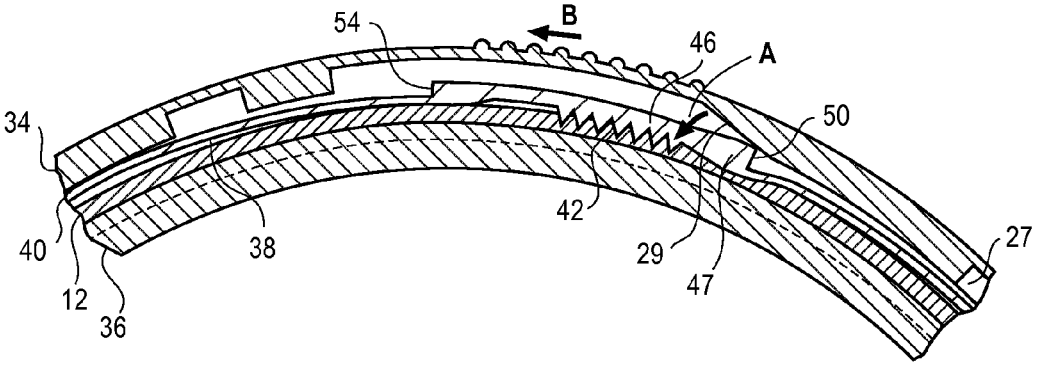
FIG. 9 is an enlarged view of a portion of the overcap of FIG. 8 after squeezing pressure has been applied to the overcap.

FIG. 9 is a view of the overcap 14 of FIG. 8 after squeezing pressure has been applied to the overcap 14 by a user. When the overcap 14 is squeezed at the gripping sections 39, the cams 29 move radially inward as shown by arrow A push the teeth segments 42 into the can body 12.

Figure 10:
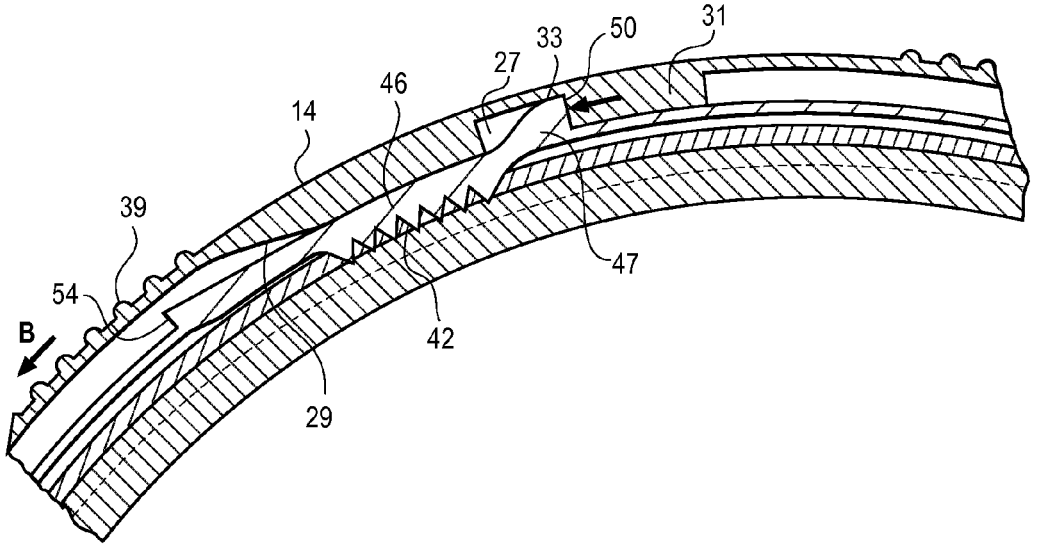
FIG. 10 is an enlarged view of a portion of the overcap of FIG. 9 after the overcap has been rotated.

FIG. 10 is an enlarged view of a portion of the overcap 14 of FIG. 9 after the overcap 14 has been rotated. When the overcap 14 is rotated in the direction indicated by arrow B, the trailing portion 47 of each teeth segment body 46 will move radially outward when the trailing portion 47 is radially aligned with a space 27 in the outer skirt 34 due to the resilience of the blade ring 40. As the overcap 14 is rotated further, the forward surface 33 of each lug 31 will abut the stopping edge 50 of each teeth segment body 46 and begin applying a rotating force to the blade ring 40, forcing the blade ring 40 to rotate along with the overcap 14. As the teeth segments 42 rotate, they make an annular cut into the can body 12 until the body 12 is cut into a top section and a bottom section. The top section can be lifted off to expose the contents of the container 10.

For greatest effectiveness the overcap 14 should be squeezed at two places around the overcap 14 about 180 degrees apart and coinciding with the location of two of the teeth segments 42. Typically the overcap 14 must be rotated 180 degrees to completely cut the container body 14. Where six equally spaced teeth segments 42 are used and the overcap is squeezed at all six places coinciding with the six teeth segments 42, it may be possible to cut the entire circumference of the container body 12 by turning the overcap 14 only 60 degrees.

It is understood that the embodiments of the disclosure described above are only particular examples which serve to illustrate the principles of the disclosure. Modifications and alternative embodiments of the disclosure are contemplated which do not depart from the scope of the disclosure as defined by the foregoing teachings and appended claims. It is intended that the claims cover all such modifications and alternative embodiments that fall within their scope.

The invention claimed is:

1. A closure for a container having a body comprising a cylindrical sidewall, the closure comprising:

an overcap comprising a covering portion and an annular portion comprising an annular rim, an outer skirt extending downward from an outer edge of the annular rim and an annular inner wall extending downward from an inner edge of the annular rim to the covering portion; and a blade ring located between an interior surface of the overcap outer skirt and the container body and comprising at least two teeth segments circumferentially spaced around and extending radially inwardly from a ring-like structure and at least two teeth segment bodies located on an outer surface of the ring-like structure, each teeth segment body located opposite a teeth segment, each teeth segment body having a raised trailing portion extending radially outward from the rest of the blade ring, a stopping edge circumferentially rearward of the trailing portion, and a forward edge circumferentially opposite the stopping edge, wherein the at least two teeth segments are radially moveable between a first, radially outward position in which the teeth segments do not cut into the body sidewall and a second, radially inward position in which the teeth segments cut into the body sidewall.

2. The closure of claim 1 wherein:

the overcap outer skirt has an interior surface and defines circumferentially spaced apart recesses for receiving and retaining each teeth segment body, wherein the recesses extend radially outward from the interior surface.

3. The closure of claim 2 wherein:

the outer skirt further comprises visibly perceptible gripping sections located on an exterior surface of the outer skirt radially opposite the circumferentially spaced apart recesses.

4. The closure of claim 2 wherein:

the outer skirt defines a plurality of circumferentially spaced apart spaces for receiving the raised trailing portion of each teeth segment body and comprises one or more inwardly extending cams configured to push against the raised trailing portions when a radially inward force is imposed on the outer skirt, the outer skirt further comprising one or more inwardly extending lugs, each lug having a forward facing surface facing one of the spaces in the outer skirt, each forward facing surface configured to push against a corresponding raised trailing portion when the outer skirt is squeezed and rotated.

5. The closure of claim 1 wherein the container body is made primarily of paper.

6. A method of opening a container having a body and sealed by the closure of claim 4, the method comprising the steps of:

squeezing the outer skirt until the teeth segments cut into the body;

rotating the overcap to circumferentially cut the body until the body is cut into two pieces; and lifting off the overcap.

7. The method of claim 6 wherein the outer skirt is squeezed at two places around the overcap about 180 degrees apart and coinciding with the location of two of the teeth segments and the overcap is rotated 180 degrees.

8. The method of claim 7 wherein the blade ring comprises six teeth segments, the overcap is squeezed at places coinciding with the six teeth segments, and the overcap is rotated 60 degrees.

* * * * *